US005357679A

United States Patent [19]

Hanna

[11] Patent Number: 5,357,679

[45] Date of Patent: Oct. 25, 1994

[54] BAG OPENING DEVICE

[76] Inventor: Lori A. Hanna, 508 Valley Dr., Dickinson, Tex. 77539

[21] Appl. No.: 136,170

[22] Filed: Oct. 15, 1993

[51] Int. Cl.[5] ..... B67B 7/00

[52] U.S. Cl. ..... 30/294; 30/2; 30/DIG. 3

[58] Field of Search ..... 30/294, 2, DIG. 3, 289, 30/278, 314, 334, 280

[56] References Cited

U.S. PATENT DOCUMENTS

| | | | |
|---|---|---|---|
| 1,214,894 | 2/1917 | Camillieri | 30/DIG. 3 |
| 1,843,535 | 2/1932 | Arnold | 30/2 |
| 2,067,986 | 1/1937 | Schmidt | 30/2 |
| 2,686,969 | 8/1954 | Furey . | |
| 4,360,970 | 11/1982 | Ostroski et al. | 30/2 |
| 4,711,031 | 12/1987 | Annello | 30/294 |
| 5,007,171 | 4/1991 | Horning, Jr. | 30/294 |
| 5,103,562 | 4/1992 | Braatz | 30/294 |

*Primary Examiner*—Richard K. Seidel
*Assistant Examiner*—Hwei-Siu Payer
*Attorney, Agent, or Firm*—John S. Egbert; Al Harrison

[57] ABSTRACT

A bag-opening device having a first plate with a first perimeter extending therearound, a second plate connected to the first plate and having a second perimeter extending therearound, and a blade affixed to one of the first and second plates and positioned generally centrally therein. The first and second plates are movable between a first bag-receiving position and a second bag-opening position. The first and second plates have a V-shaped configuration in the first position and are in parallel relationship in the second position. The blade is positioned perpendicular to the plates in the second position. The first and second plates are integrally formed together of a memory-retentive polymeric material. The first plate has a first neck extending rearwardly therefrom. The second plate has a second neck extending rearwardly therefrom. These necks have a width less than a width of the first and second plates. The blade has a pointed V-shaped configuration extending downwardly from a surface of one of the plates. The blade is a double-edged blade.

17 Claims, 1 Drawing Sheet

BAG OPENING DEVICE

TECHNICAL FIELD

The field of the invention relates to severing apparatus. More particularly, the present invention pertains to a new and improved bag opener apparatus which permits the reception of a conventional bag within the apparatus to permit severing of the bag as the apparatus is manually directed across an upper end of the bag.

BACKGROUND ART

A large number of food products are packaged in various types of sealed bags. The examples of such bags are the relatively thick plastic bags known as retort pouches in which meats and frozen vegetables are packaged, the relatively thin plastic bags which contain other types of foods, and the various metal and plastic lined bags which contain food such as nuts. In order to assure an effective seal of the contents and also to protect the food against pests and theft, the bags are often intentionally constructed in a manner to prevent them from being easily opened. Consequently, many types of bags are difficult, if not impossible, to open by hand, and knives, scissors, or other instruments must be used to open them. Even when such instruments are readily available, cutting of the bag at the desired location and in the proper manner is not always achieved. As a result, it is not uncommon for the contents of such bags to be spilled during attempts to open them.

The problem of opening bags is further complicated when children desire to open such bags. Often, the children do not have sufficient strength so as to open these bags manually. On the other hand, parents are often reluctant to entrust scissors, knives, and other sharp objects to the hands of children. There is the possibility that the child could injure himself or herself if the proper implements were given to the child for the purpose of allowing the child to open the bag.

In the past, various U.S. patents have issued which relate to devices for opening containers, such as plastic bags.

U.S. Pat. No. 2,238,753, issued on Apr. 15, 1941, to E. Robie describes a package opener which has a steel strip having one end curled upwardly and inwardly so as to continue into the form of a pointed blade extending inwardly. A cover is hingedly mounted on the other end of the steel strip and extends across the strip to cover the blade portion. The cover is arched so as to extend over the blade portion. The cover is resiliently connected to a portion of the strip.

U.S. Pat. No. 2,686,969, issued on Aug. 24, 1954, to L. M. Furey teaches a container band severing tool. This tool has a long handle extending outwardly from a pair of surfaces. These surfaces are integrally connected together in the form of a curved strip of material. A pair of pointed blades extend inwardly from this strip of material. These blades are overlapped so as to form a proper cutting action.

U.S. Pat. No. 2,881,520, issued on Apr. 14, 1959, to K. Mito describes a paper knife having a handle with a pair of arms extending outwardly from the handle. A sharp blade is positioned between the ends of the arms and extends inwardly toward the handle. An envelope, or other piece of paper, is inserted to the opening between the arms so that the sharpened edge of the knife can properly cut and tear the piece of paper.

U.S. Pat. No. 4,360,970, issued on Nov. 30, 1982, to Ostroski et al., describes a device for opening sealed bags containing foods of various types. A lever is pivoted to one end of a base plate and carries a serrated cutter wheel which is mounted for free rotation. The base plate has a recess which receives the cutting edge of the cutter wheel when the lever is pressed toward the base plate to a cutting position. The bag is inserted between the lever and the base plate and is pulled through the device such that the peripheral teeth of the cutter wheel cut or perforate the bag.

U.S. Pat. No. 4,711,031, issued on Dec. 8, 1987, to J. Annello provides a letter opener for cutting off the edge of an envelope. This letter opener has a deformable U-shaped body. A cutting blade is located in the upper wall of the body and a hole positioned to receive the blade is located in the lower wall. An abutment attached to the lower wall serves both as a guiding surface for an envelope and as a stopper to prevent the two walls from binding against the envelope when pressed together. The device is used by placing a corner of an envelope against the abutment, pressing the two walls together so as to cause the blade to puncture the envelope, and drawing the device along the edge of the envelope to thereby slice off the edge of the envelope.

U.S. Pat. No. 5,007,171, issued on Apr. 16, 1991, to J. H. Horning, Jr. provides a bag opener of a generally U-shaped configuration formed of a memory retentive polymeric material. This configuration includes a first leg and a second leg arranged parallel relative to one another in a first position. A blade member is mounted within an interior surface of the first leg and is arranged parallel to beveled terminal ends of the legs to receive a bag therethrough. The blade member is directed across the surface of a bag inserted between the interior surfaces of the leg members so as to sever a bag positioned therewithin.

U.S. Pat. No. 5,101,562, issued on Apr. 7, 1992, to Horvath et al. describes a cutting squeezer tool provided for a condiment foil pouch. This item consists of an elongated flat handle so that a person using the tool can grip the handle. A mechanism is provided on the end of the handle for cutting the edge of the condiment foil pouch and for squeezing the contents out of the condiment foil pouch.

U.S. Pat. No. 5,103,562, issued on Apr. 14, 1992, to H. Braatz shows a package opening device suitable for opening packages made of cellophane and other flexible plastic material. This package opening device includes first and second plates pivotally connected at their respective back ends. The two plates are biased by a spring to an open configuration so that there is a V-shaped gap between the plates. The first plate has a cutter that faces the second plate. A package is inserted into the gap and the tool is operated in a closed configuration by squeezing the front ends of the two plates together to cause the cutter to penetrate the package. A recess in the second plate receives the entire cutter when the tool is in the closed configuration. Pulling the package from between the closed plates of the tool serves to slice the package for easy opening.

It is an object of the present invention to provide a bag opening device that is appropriate and safe for use by children.

It is another object of the present invention to provide a bag opener device that can cut the bag from either direction.

It is another object of the present invention to provide a bag opener device that can be easily opened and closed.

It is still another object of the present invention to provide a bag opener device that is easy to use, easy to manufacture, and relatively inexpensive.

These and other objects and advantages of the present invention will become apparent from a reading of the attached specification and appended claims.

SUMMARY OF THE INVENTION

The present invention is a bag opening device that includes a first plate, a second plate connected to the first plate in a V-shaped configuration, and a blade affixed centrally to a surface of one of the plates. The first and second plates are squeezable to a second position in which the first plate is in parallel relationship to the second plate. The blade is distal the other of the plates in the first position and is in contact with the other of the plates in the second position.

The first plate has a top surface and a bottom surface. The blade is affixed to the bottom surface of the first plate. The first plate has a perimeter extending therearound. The blade is positioned inwardly from any portion of the perimeter by no less than one inch. The first plate has a magnet affixed to the top surface.

The first and second plates are integrally formed together of a memory-retentive polymeric material. The first plate has a first neck extending rearwardly thereof. The second plate has a second neck extending rearwardly of the second plate. The first neck is joined to the second neck. Each of the first and second necks has a width less than a width of the first and second plates. The first neck has the magnet affixed thereto on a side opposite the second neck.

The blade has a pointed V-shaped configuration extending downwardly from a surface of the first and second plates. The blade is a double-edged blade. The blade is perpendicular to the first and second plates in the second position. The blade extends downwardly from one of the plates for a distance of approximately 0.02 inches.

The first plate has a first edge opposite to the first neck. The second plate has a second edge opposite to the second neck. These edges are in the form of a pair of lips.

DETAILED DESCRIPTION OF THE INVENTION

Figure 1:
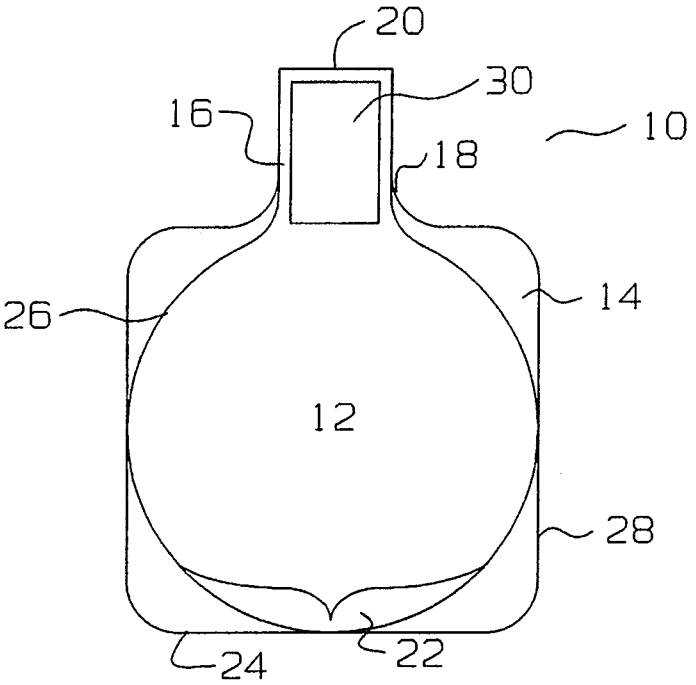
FIG. 1 is a plan view of the bag opening device of the present invention.

Referring to FIG. 1, there is shown at 10 the bag opening device in accordance with the present invention. The bag opening device 10 includes a first plate 12, and a second plate 14. The first plate 12 has a first neck 16 extending rearwardly therefrom. Similarly, the second plate 14 has a second neck 18 extending rearwardly therefrom. The first neck 16 is joined to the second neck 18 along rearward edge 20.

In FIG. 1, it can be seen that the first plate 12 has a generally circular configuration. The first plate 12 has a forward edge 22 opposite to the rearward edge 20. As can be seen, the forward edge 22 is in the form of lips. As will be described hereinafter, the second plate 14 has a forward edge 24 which is also in the form of lips. As such, an end view of the configuration of the bag opening device 10 will show a pair of lips, somewhat in the form of a mouth, along the edges 22 and 24 of the plates 12 and 14, respectively.

It can be seen that the first plate 12 has a generally circular configuration with a perimeter 26 extending therearound. The perimeter 26 extends along the forward edge 22 and will extend rearwardly until the neck portion 16 extends outwardly therefrom. The second plate 14 has a contoured, somewhat rectangular, configuration around its perimeter 28. The perimeter 28 is contoured so as to taper into the second neck 18 at the rearward end 20 of the second plate 14. A magnet 30 is positioned on the top surface of the first neck 16 of the first plate 12 of the bag opening device 10. Magnet 30 has a generally rectangular configuration. The magnet 30 is configured so as to allow the user of the bag opening device 10 to conveniently place the device on a metallic surface, such as a refrigerator door.

In FIG. 1, it can be seen that the first neck 16 has a width less than the width of the first plate 12. Similarly, the second neck 18 has a width less than the width of the second plate 14. The configuration of the necks 16 and 18 has been selected so as to allow for more convenient opening and closing of the plates 12 and 14 relative to each other. Since the plates 12 and 14 are made of a memory-retentive polymeric material, such as polycarbonate, it is important to minimize the area of connection between the first plate 12 and the second plate 14. As such, for the purposes of allowing children to operate the bag opening device 10, the necks 16 and 18 have been constructed with a width less than that of the first plate 12 and/or the second plate 14.

Figure 2:
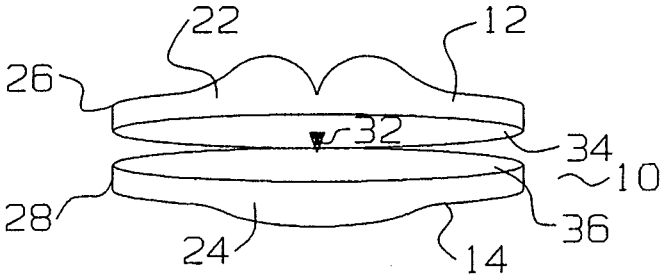
FIG. 2 is an end view of the bag opening device of the present invention.

FIG. 2 shows the configuration at the open end of the bag opening device 10. The bag opening device 10 is illustrated, in FIG. 2, in its bag receiving position. In this bag-receiving position, it can be seen that the first plate 12 is open with respect to the second plate 14. As will be described hereinafter, the first plate 12 forms a V-shaped configuration with the second plate 14. The edge 22 of the first plate 12 and the edge 24 of the second plate 14 have a lip-shaped configuration. It is possible within the concept of the present invention that the edges 22 and 24 can take on other novel arrangements, such as alligator jaws or the mouth of a dog, or a similar mouth-shaped form. The shape of the end edges 22 and 24 has been selected so as to be particular attractive to children. The shape of the end edges 22 and 24, in the form of a mouth, is educational to children in that it teaches children that the edge of the bag is to be inserted into the "mouth" of the device 10.

In FIG. 2, it can be seen that a blade 32 is affixed centrally to the bottom surface 34 of the first plate 12. The blade 32 is distal to the top surface 36 of the second plate 14 when the plates 12 and 14 are in their first, bag-receiving, position. When the plates 12 and 14 are squeezed so as to close toward each other, the blade 32 will have its pointed end in contact with the top surface 36 of the second plate 14. The blade 32 has a pointed V-shaped configuration extending downwardly from the bottom surface 34 of the first plate 12. The blade 32 is a double-edged blade so that the bag can be cut in either direction. The blade 32 is positioned perpendicular to the first plate 12 and the second plate 14 when the plates 12 and 14 are closed into the bag-opening position. The blade 32 extends downwardly from the plate 12 for a distance of approximately 0.02 inches.

Importantly, it can be seen that the blade 32 is centered within the perimeter 26 of the first plate 12. Under the preferred embodiment of the present invention, the blade 32 will be positioned no less than one inch from any point around the perimeter 26 of the plate 12. Because of the small size of the blade 32, and the relatively large distance of the blade 32 from the perimeter 26 of the top plate 12, it is extremely difficult, if not impossible, for a child to reach the blade 32. The small distance of the opening between the plates 12 and 14 makes it difficult for the child to insert his or her fingers into the area between the plates 12 and 14. Even if the child manages to place his or her fingers between the small opening of the plates 12 and 14, the length of the child's fingers will not reach the position of the blade 32. As such, the sharp blade 32 can be used by a child without fear of injury to the child. The arrangement of this device will allow the child to properly learn techniques for cutting objects in a safe, convenient, and efficient manner.

Figure 3:
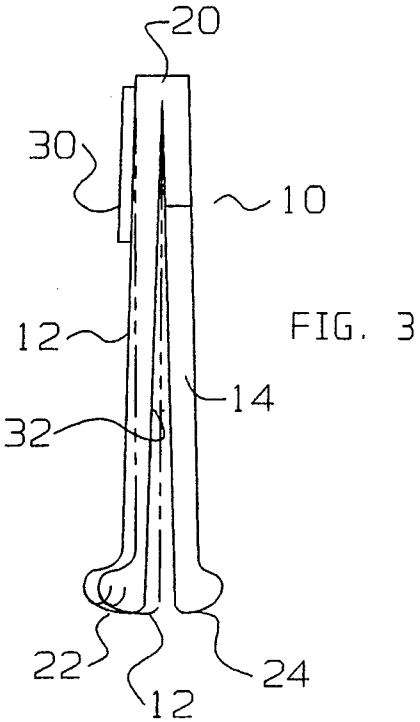
FIG. 3 is a side view of the bag opening device of the present invention showing the device in its bag opening position in a dotted line fashion.

FIG. 3 shows the bag opening device 10 between its bag receiving position (illustrated in solid line fashion), and its bag-opening position (illustrated in broken line fashion). Initially, it can be seen that the bag opening device 10 includes the first plate 12 and the second plate 14. The first plate 12 and the second plate 14 are integrally formed together at end 20. The plates 12 and 14 can be formed by plastic molding processes. The magnet 30 is affixed to the top surface of the plate 12. The end edge 22 is illustrated in the form of the upper lips. The second plate 14 has a length generally equal to the length of the first plate 12. The end edge 24 of the second plate 14 is in the form of the bottom lips. As illustrated in FIG. 3, the first plate 12 and the second plate 14 are in the form of a V-shaped configuration. The V-shaped configuration is also important so as to avoid the risk of having a child insert fingers into the area between the plates 12 and 14. The V-shaped configuration is also easier to form, in resilient fashion, by plastic molding processes. The blade 32 is positioned centrally of the first plate 12 at a distance of no less than one inch from the end edges 22 and 24. The V-shaped configuration of the area between the plates 12 and 14 also provides a guide area for the insertion of the edge of a plastic bag.

In FIG. 3, it can be seen in dotted line fashion that the first plate 12 is squeezable so as to move into a position which is generally perpendicular to the second plate 14. In this second position, the blade 32 will be perpendicular between the first plate 12 and the second plate 14. In the second bag-opening position, the blade 32 will pierce the bag. The double-edges of the blade 32 will allow the bag to be opened by pulling the bag across the blade 32 in either direction. As long as the plates 12 and 14 are squeezed together, the blade 32 will properly cut along the edge of the bag. After the cutting has been completed, the squeezing forces between the plates 12 and 14 are removed, and the bag can be easily removed from the area between the plates 12 and 14. In this manner, the bag has been safely, conveniently, and efficiently opened.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. A bag opening device comprising:

a first plate having a neck extending rearwardly therefrom;

a second plate connected to said first plate in a V-shaped configuration in a first position, said first and second plates being squeezable to a second position in which said first plate is in parallel relationship to said second plate, said second plate having a neck extending rearwardly therefrom, said necks being joined together, each of said necks having a width less than a width of said first and second plates, said first and second plates being integrally formed together of a memory-retentive polymeric material; and a blade affixed centrally to a surface of one of said plates, said blade being distal the other of said plates in the first position and in contact with the other of said plates in said second position.

2. The device of claim 1, said first plate having a top surface and a bottom surface, said blade being affixed to said bottom surface of said first plate.

3. The device of claim 2, said first plate having a perimeter extending therearound, said blade positioned inwardly from any portion of said perimeter by no less than one inch.

4. The device of claim 2, said first plate having a magnet affixed to said top surface.

5. The device of claim 1, said neck of said first plate having a magnet affixed thereto on a side opposite said neck of said second plate.

6. The device of claim 1, said blade having a pointed V-shaped configuration extending downwardly from said surface of said one plate.

7. The device of claim 6, said blade extending downwardly from said one plate for a distance of approximately 0.02 inches.

8. The device of claim 6, said blade being a double-edged blade.

9. The device of claim 8, said blade being perpendicular to said first and second plates in said second position.

10. A bag opening device comprising:

a first plate having a perimeter extending therearound, said first plate having a neck extending rearwardly therefrom;

a second plate connected to said first plate, said second plate having a perimeter extending therearound, said first and second plates movable between a bag-receiving position and a bag-opening position, said second plate having a neck extending rearwardly therefrom, said necks being joined together, each of said necks having a width less than a width of said first and second plates; and a blade affixed to one of said first and second plates and positioned generally centrally therein approximately one inch from the perimeters of said first and second plates.

11. The device of claim 10, said first and second plates having a V-shaped configuration in said bag-receiving position, said first and second plates being in parallel relationship in said bag-opening position, said blade positioned perpendicular to said plates in said bag-opening position.

12. The device of claim 11, said first and second plates being integrally formed together of a memory-retentive polymeric material.

13. The device of claim 10, said blade having a pointed V-shaped configuration extending downwardly from a surface of said one plate, said blade being a double-edged blade.

14. The device of claim 10, each of said first and second plates having an outer edge formed in a lip-shaped configuration.

15. A bag opening device comprising:

a first plate having a neck extending rearwardly therefrom;

a second plate having a neck extending rearwardly therefrom, said necks being joined together at one end, said neck of said first plate having a width less than a width of said first plate, said neck of said second plate having a width less than a width of said second plate; and a blade affixed to a surface of one of said plates and extending toward the other of said plates, said blade movable between a bag-receiving position and a bag-opening position.

16. The device of claim 15, said necks extending from each other in a V-shaped configuration, said necks being integrally formed together of a memory-retentive polymeric material.

17. The device of claim 15, said first plate having an edge opposite said neck of said first plate, said second plate having an edge opposite said neck of said second plate, said edges being in a form of a pair of lips.

* * * * *